United States Patent [19]

Lipschutz

[11] 3,988,911

[45] *Nov. 2, 1976

[54] CYLINDER LOCK

[75] Inventor: Paul Lipschutz, Croissy sur Seine, France

[73] Assignee: Societe d'Exploitation des Brevets Neiman, Courbevoie, France

[ * ] Notice: The portion of the term of this patent subsequent to Dec. 24, 1991, has been disclaimed.

[22] Filed: May 21, 1974

[21] Appl. No.: 472,022

Related U.S. Application Data

[63] Continuation-in-part of Ser. No. 361,109, May 17, 1973.

[30] Foreign Application Priority Data

May 22, 1973 France ..... 73.18510

[52] U.S. Cl. ..... 70/362; 70/364 R; 70/376; 70/377

[51] Int. Cl.[2] ..... E05B 29/00

[58] Field of Search ..... 70/362, 357, 364 R, 70/365, 366, 377, 376

[56] References Cited

UNITED STATES PATENTS

| | | | |
|---|---|---|---|
| 1,594,297 | 7/1926 | Muzzio | 70/365 |
| 1,653,511 | 12/1927 | Schlage | 70/365 |
| 3,404,548 | 10/1968 | Keefer | 70/377 |
| 3,855,829 | 12/1974 | Lipschutz | 70/362 |

FOREIGN PATENTS OR APPLICATIONS

| | | | |
|---|---|---|---|
| 552,945 | 5/1923 | France | 70/366 |
| 615,008 | 12/1926 | France | 70/366 |

*Primary Examiner*—Casmir A. Nunberg
*Assistant Examiner*—Victor N. Sakran
*Attorney, Agent, or Firm*—Nolte and Nolte

[57] ABSTRACT

A cylinder safety lock the rotor of which carries a plurality of longitudinally extending parallel resiliently flexible elongated longitudinal elements arranged in circumferentially spaced relationship about and at the same radial distance from the longitudinal center line axis of the lock and engageable in the absence of a key with corresponding grooves of an inner coaxially positioned core portion of the stator of the lock to hold said rotor against rotation; said elongated elements being engageable with an inserted key for being deflected radially outwards either into an annular space left between said stator and core for unlocking said rotor when the key is correct or beyond said intermediate space into corresponding grooves of said stator to still lock said rotor when the inserted key is wrong.

8 Claims, 20 Drawing Figures

CYLINDER LOCK

This is a continuation in part of the U.S. patent application Ser. No. 361,109 filed on May 17, 1973.

The present invention relates to a key-operated safety cylinder lock with a large number of coded combinations and offering over the conventional prior art known cylinder locks of the pin tumbler or disk tumbler kind the advantage of a greater simplicity and a faster assembly work without requiring the high accuracy or precision manufacture required for these conventional cylinder locks.

A pin tumbler cylinder lock consists of a stator casing or shell, of a barrel-like or plug-shaped substantially cylindrical inner rotor, and of pluralities of pairs of registering cylindrical pins slidably located in said stator and rotor, respectively, and biased radially inwards by corresponding resilient means. There is accordingly provided for every combination element, four parts, namely an inner tumbler pin, an outer tumbler pin adapted to be aligned in registering relationship with said inner tumbler pin for a given angular position of said rotor, a spring and a latch member for locking the whole assembly.

The manufacture of such a lock is expensive in view of the accuracy or precision making required and also owing to the delicate or tricky workmanship or operating steps required for assembling the whole since it involves handling very tiny component parts.

The disk or plate tumbler lock is of a significantly simpler construction than said pin tumbler lock. Such a structural simplification is however achieved at the expense of a lesser effectiveness or efficiency and a lower locking reliability. This type of lock has for every combination element three parts only, namely, one plate or disk member, a spring and an element holding said plate member against motion.

It is less expensive that the pin tumbler cylinder lock but less effective. The assembly mounting is difficult since involving as in the previous case handling very small component parts.

The present invention is based upon a new and improved principle providing a lock with longitudinal elongated elements. One main object of the invention is to provide a cheap lock enabling to carry out a large number of combinations. This lock while being very effective requires neither a high precision for its manufacture nor any handling of tiny component parts.

The number of component parts forming this new lock is reduced in the case of elongated elements of blade-like character in the proportion of 18 to 8 with respect to a pin tumbler cylinder lock and of 13 to 8 with respect to a disk or plate tumbler cylinder lock.

Thus the invention relates to a safety cylinder lock comprising a hollow stator body, a key-responsive inner cylindrical rotor member rotatably mounted within said stator body and rotatable by a removable key formed with notches and insertable into said rotor member, and key-operated locking means carried by said rotor member and operable by the translatory axial motion of said key to be releasably engageable with said stator body, wherein the improvement consists in that said stator body comprises an outer cylindrical casing portion and an inner substantially cylindrical core portion at least partially co-extensive in coaxial relationship with said outer casing portion to leave therebetween an intermediate gap-like annular space into which at least one portion of said rotor member extends, the lateral peripheral surface of said inner core portion being formed with a number of circumferentially spaced longitudinal grooves whereas said locking means comprise a plurality of longitudinal elongated elements secured with one end to said rotor member and extending in at least approximately generally parallel relation to the longitudinal centre line axis of said lock and to said grooves, said elongated elements being arranged in circumferentially spaced relationship about and at at least approximately the same radial distance from said centre line axis according to a configuration coaxially surrounding said stator core portion and fitted with clearance in said annular intermediate space to be rotatable therein together with said rotor, said elongated elements being movable in respective corresponding axial planes and distributed so as to be alternatively on the one hand removably engageable automatically through an elastic biasing action and radially inward motion with at least some of said grooves provided in said stator core portion to hold said rotor member against rotation when said key is removed, and on the other hand moved radially outwards by the inserted key so as to be located in their at least partially radially outward displaced positions within said intermediate annular space while being disengaged from said grooves of said stator core portion for allowing free rotation of said rotor member, each elongated element being formed at its free end with a radially inward projecting catch nose adapted to co-operate with said key in the fully inserted position of the latter and to engage one corresponding notch thereof for moving said elongated element out of and into said grooves.

One of the main characterizing features of one embodiment of the new lock consists in that one single member provided with blade-like elements secured to the rotor performs the combined functions of locking and resilient biasing action towards the rest positions when the key is removed.

The invention will be better understood and further objects, characterizing features, details and advantages thereof will appear more clearly as the following description proceeds with reference to the accompanying diagrammatic drawings given by way of non-limiting examples only and illustrating several specific presently preferred embodiments of the invention. In the drawings.

Figure 1:
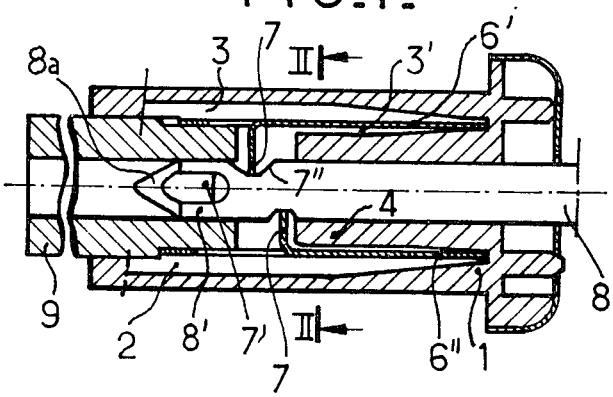
FIG. 1 shows a view in longitudinal section of the lock according to one embodiment of the invention with the key fully inserted and the rotor in unlocked condition.

In FIG. 1 is clearly seen the stator 1 formed with a cavity 2 provided with a cylindrical inner core portion 4 guidingly engageable by resiliently flexible or yielding elements having the shape of webs, strips, leaves, blades, reed-like tongs or the like bodily forming a substantially cylindrical open-work, lattice-work or grating-like skeleton structure or being independent from each other but all secured for instance by key-bolt means or cutter-pin means or spline means or setting, crimping or staking means to the rotor 9 for being driven or carried along in rotary motion thereby, the rotor being rotatably mounted within the bore provided in the end portion of the stator. Alternatively, instead of being resiliently flexible, the blade-like elements could be pivotally or otherwise movably connected to the rotor and biased by separate resilient means cooperating with said blade-like elements.

The resilient blade-like elements 6′, 6″, 6‴, 6⁗ are bent radially inwards at their ends to form a substantially radially inward directed projection of selectively variable length or size to form a kind of catch nose, dog, feather, snug spigot, lug or the like for circumferentially aligning said blade-like elements in a same cylindrical surface located within the intermediate annular gap or space 2 left between the outer cylindrical shell or casing portion 1 of the stator and said inner core portion 4, when said projections or catch noses 7 exactly correspond to the positions and depths of the notches 7″ formed on the cylindrical key shank 8.

The shape and size of the cavity enables the rotation of the rotor and of the assembly with the blade-like elements within the stator.

The stator body portion or outer casing 1 is formed with grooves or like recesses such as 3 the number of which is for instance equal to that of the blade-like elements 6′, etc. which may be received therein when they are pushed radially outwards by the key 8 and in particular by those cylindrical portions of this key which are devoid of notches 7″ or provided with too shallow notches, i.e. notches of insufficient depth.

Figure 6:
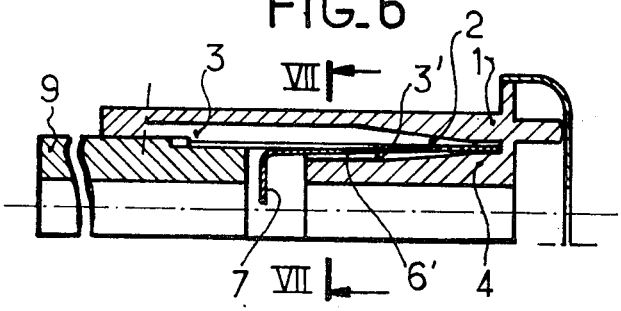
FIG. 6 is a fragmentary longitudinal sectional view of the lock, the key having been removed and the blade-like elements being in their free released position.

When the key 8 is withdrawn or when the rotor does not present its blade-like elements in front of corresponding notches 3 of the outer stator casing 1, the blade-like elements move back to their release positions as shown in FIG. 6 wherein is shown one blade-like element 6′ positioned within a groove 3′ formed in the inner core 4 of the stator in confronting relation with a groove 3 of the outer cylindrical casing 1 of the stator, which core groove 3′ therefore locks the rotor to prevent rotation thereof.

Figure 7:
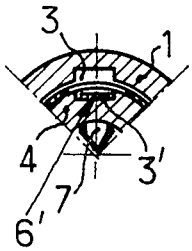
FIG. 7 is a cross-section taken upon the line VII—VII of FIG. 6 and illustrating the position of one of said blade-like elements.

FIG. 7 clearly shows the position of one blade-like element 6′ within the core notch 3′.

Therefore, in order that the rotor may be unlocked, the following conditions or requirements must be met or complied with:

1. The key 8 is fully inserted into the lock.

2. The notches 7″ of the key 8, in view of their depth, lift or raise the blade-like elements 6′, 6″, 6‴, 6⁗, etc. by a distance corresponding exactly to the height or length of the catch noses 7 so as to cylindrically align all of the blade-like elements 6′, etc. within the annular relatively narrow gap 2 of the stator, defined between the outer cylindrical casing 1 and the inner cylindrical core 4 of the stator for allowing free rotation of the rotor.

3. The notches 7″ of the key 8 must be located exactly in registering relation to the catch noses 7 of the blade-like elements 6′, etc. corresponding to the shape and depth of the notches 7″ of the key and the catch noses 7 may be provided at various mutually differing positions along the longitudinal generating lines or direction of said blade-like elements (which may therefore be of mutually differing lengths).

It is thus conceivable that there is thereby available a new variable factor to make the key code more complicated, which code depends in particular on the following parameters:

1. the lengths of the blade-like elements 6′, etc.;
2. the number of blade-like elements;
3. the azimuthal distribution of the blade-like elements about the longitudinal axis of the lock;
4. the size of the catch noses 7;
5. the longitudinal distribution of the catch noses with respect to their positions along the longitudinal lock axis;
6. the shapes of these catch noses 7;
7. the arbitrary or selectively variable shape of the drive cavity 10 within the rotor 9.

Figure 2:
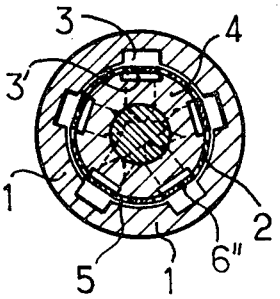
FIG. 2 is a cross-section through said lock taken upon the line II—II of FIG. 1.

In FIGS. 1 and 2 for instance, there is shown a stator 1, 4 formed with five grooves 3, 3′ provided in the casing 1 and rotor 4 together with a plurality of five blade-like elements 6′, etc. It is however obvious that it is always possible without departing from the scope of the invention to provide a stator with three, six, eight or more grooves and a rotor with two, three, four or more blade-like elements, provided that the distribution of the latter correspond for an angular orientation thereof to the positions of the grooves 3, 3' of the stator or of those particular grooves which have been selected for a given code combination. It is conceivable that the number of combinations may be very large and the security or safety offered by the lock of the invention is accordingly very high as is its reliability or dependability.

Figure 5:
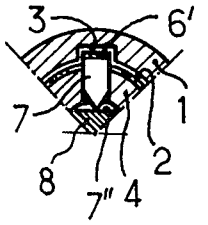
FIG. 5 is a fragmentary sectional view of the same rotor taken upon the line V—V of FIG. 4 and showing in particular the position of a blade-like element remaining in locking position in the presence of a wrong key.
Figure 4:
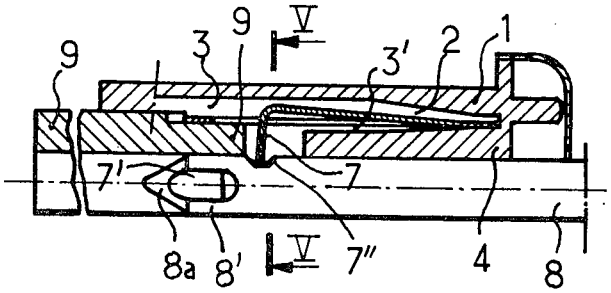
FIG. 4 shows a fragmentary longitudinal sectional view of the lock with an inserted wrong key unable to unlock or free the rotor for rotation.

In particular in FIGS. 2 and 5 of the accompanying drawings, there are shown V-shaped catch noses 7 of blade-like elements to facilitate the rotation of the key and the positioning of the blade-like elements. A half-round or ogival shape may however also be used. The radially inner bottom portion 7'' of the key 8 is shown in FIG. 2 as being of substantially flat configuration but it may also assume a curved shape.

Figure 9:
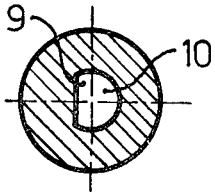
FIG. 9 is a cross-section through the key-operated portion of the rotor, showing an open recess provided endwise in said rotor portion and formed with a flattened portion for being rotatably driven by the inserted key.

The driving of the rotor is effected by the end tip 8' of the cylindrical key 8, which tip is formed for instance with a flattened portion 7' which is engageable with and adaptable to a complementary cavity or open recess 10 of mating shape provided in the rotor 9 as shown in cross-section in FIG. 9. It is obvious that the several possible various shapes and positions of the rotor drive portion offers an additional variety of combinations corresponding to different sets of keys. For all these sets, however, the end tip 8' of the key 8 is shaped into a conical or tapered portion 8*a* to facilitate insertion into the lock irrespective of the actual angular orientation of the key or lock.

Due to the very large number of combinations possible with such a lock, the required manufacturing precision is relatively moderate since it would be sufficient to give every blade-like elements 6', etc. and every groove 3, 3' characteristic features such that the deformation or deflection of the blade-like elements out of the locked position allows a tolerance of a few tenths of a millimeter, which accuracy is very easily attained with an economical manufacture.

Figure 10:
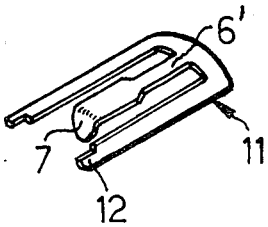
FIG. 10 is a perspective view of a separate blade element carrying part.
Figure 3:
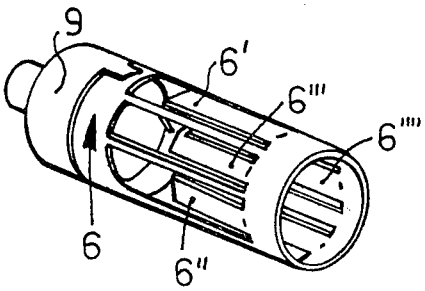
FIG. 3 is a perspective view of an embodiment of a possible construction of the rotor provided with a cylindrical member carrying the blade-like elements.
Figure 8:
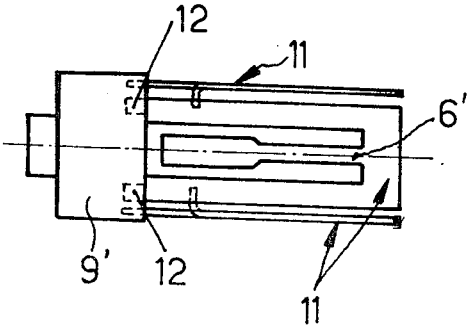
FIG. 8 is an outside elevational view of an alternative embodiment or modification of the rotor carrying the blade-like elements.

Since the making of a cage-like blade-holder such as shown in FIG. 3 through punching or cutting with a suitable press may require expensive tools or implements, it is possible for more reduced series production and investments to use the alternative embodiment shown in FIGS. 8 and 10 wherein the rotor drive portion 9' is fitted, through assembling, setting, staking or crimping, riveting, cottering, welding, brazing or soldering carried out on connecting lug portions 12, with pitch-fork like members 11 carrying a blade-like element 6' between the prong-like legs of member 11 and connected endwise for example integrally with the cross-bracing portion of said member. Such blade holders 11 are still more easily made with respect to shape and size according to requirements.

In all these embodiments, the manufacture through moulding of plastics material or through precision casting of suitable alloys of rotor 9 and stator 11 still adds or contributes to the intended saving without impairing quality.

The manufacture of the cage-like blade-holder 6 (FIG. 3) or of separate or independent blade-like elements 11 may use special manufacturing processes and methods without departing from the principle of the invention.

Finally the assembling of the blade-like elements and the rotor as well as the mounting of the lock avoid tricky handling and precision adjusting or fitting steps.

The constructions described hereinabove involve a number of manufacturing steps for making same such as in particular the bending step for providing said catch noses and said blade-like elements, the making of a squirrel cage-like structure and securing same to the rotor and it may be sometimes difficult to replace a defective blade-like element (for instance broken or affected by a permanent set); also the substantial width of each blade like element in the circumferential direction may limit the total number of possible code combinations and there may be some scrapping during manufacture of said locks.

The following additional embodiment of the invention allows to simplify the manufacture and to avoid or remove said difficulties by providing improved locking means characterized in that each elongated element consists of a rigid pawl-like swinging lever pivotally connected to said rotor with one end whereas a resiliently deformable ring or collar exerting a radial centripetal biasing or return action surrounds and encompasses the whole assembly of said levers in co-operating relationship to simultaneously urge the latter constantly towards their radially inward swung or deflected position.

Thus each resiliently deformable blade-like element of said known lock is replaced by a rigid pawl-like lever co-operating with a biasing or draw-back ring-shaped device made from resiliently deformable material such as a silicone rubber for instance and serving as a single collector spring exerting a radial action upon several levers at the same time.

This further embodiment is therefore advantageous by providing an increased reliability, reduced manufacturing costs, simplicity of construction, easy replacement or interchangeability of said levers individually mounted removably on said rotor and reduced maintenance.

In FIGS. 11 to 14 is shown a lock stator 1 provided with an inner cylindrical core portion 4 serving as a guide means and accommodation for new locking elements, with radially outer longitudinal grooves or like passageways 3 provided in the cylindrical case portion of larger diameter of said stator, and radially inner longitudinal grooves or like elongated recesses 3' formed in said inner cylindrical core portion, as well as a partial view of an operating key 8 the tip or end portion 8' of the shank thereof is formed with a flattened portion 7' which co-operates with a complementary flattened portion 10 of a cavity provided in the lock rotor 9.

The blade-like elements disclosed hereinabove are replaced herein by pawl-like rigid tumbler or swinging levers 16 pivotally connected about respective pivots 15 consisting for instance of a half-torus shaped ring segment with a half round cross-section, the arm portion of each rigid lever 16, extending in substantially parallel relation to the longitudinal centre line axis of the lock, being accommodated or housed within radial slot or slit-like openings 3'' provided and circumferentially distributed in the rotor 9.

Figure 13:
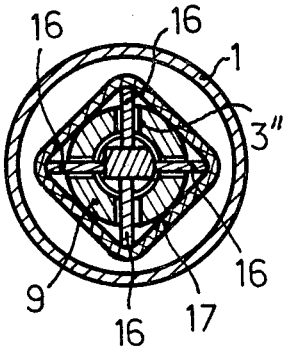
FIG. 13 is a cross-sectional view taken upon the line XIII—XIII of FIG. 11 and showing said ring or collar made from resilient material bearing or pressing simultaneously upon four aforesaid locking levers.
Figure 20:
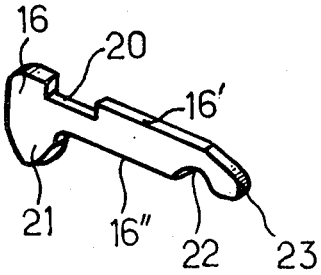
FIG. 20 is a separate perspective view of an aforesaid rigid lever.

A ring or like collar made from elastic material 17 serves as a return spring for several levers at the same time (FIG. 13). This ring is kept in substantially stationary position in longitudinal direction by a notch or like retaining recess 20 provided for this purpose in each lever 16 (FIG. 20).

An intermediate void space 27 having the shape of a peripheral groove (FIGS. 11 and 17) is provided between the stator and the rotor to allow free rotary motion of the assembly consisting of the rotor 9 and the levers 16 connected to the rotor 9 as well as the swinging or pivotal movements of said levers.

Figure 11:
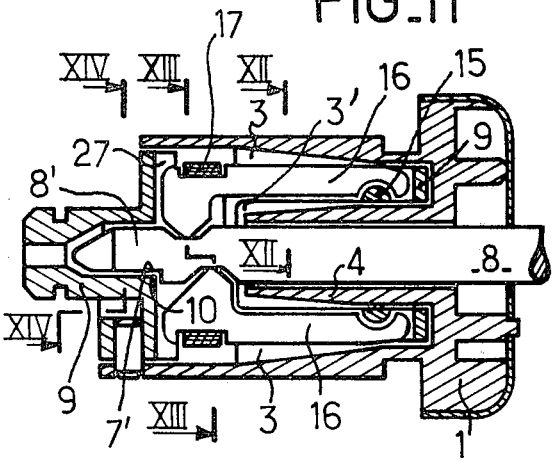
FIG. 11 shows a longitudinal section through the new lock in unlocked position thereof, with the right key inserted.
Figure 12:
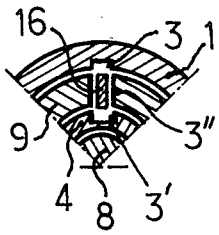
FIG. 12 is a fragmentary view in cross-section taken upon the line XII—XII of FIG. 11 and showing one pawl-like lever in neutral position, i.e. in unlocking position.

FIG. 12 shows the centred position of one rigid lever 16 in substantially parallel relationship with the longitudinal centre line axis of the lock, within an associated slot-like opening 3'' of the rotor in said intermediate annular space between said registering or confronting grooves 3 and 3' to enable the rotor to be freely driven or rotated by the key in the position shown in FIG. 11 (unlocked lock).

Figure 17:
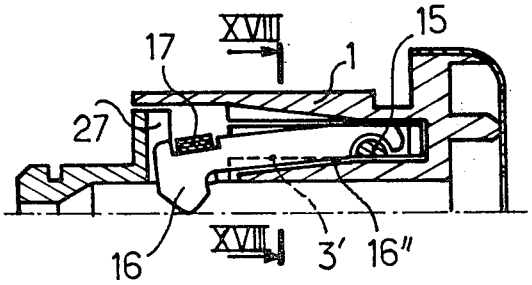
FIGS. 17 and 18 illustrate the locking of the lock by withdrawal of the key as shown in fragmentary views similar to FIGS. 15 and 16, in longitudinal half-section and in partial cross-section taken upon the line XVIII—XVIII of FIG. 17, respectively.
Figure 18:
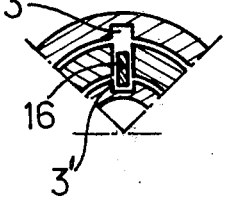

FIG. 13 shows the elastic return device exerting a resilient centripetal action upon all of said levers at a time and consisting of the elastic ring 17; it is the action of this new kind of spring upon the head portions or free end portions of the levers 16 which moves same into the positions engaging the radially inner longitudinal grooves 3' of the stator core portion when the key has been withdrawn (FIGS. 17 and 18).

Figure 14:
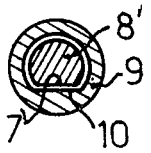
FIG. 14 is a view in cross-section taken upon the line XIV—XIV of FIG. 11 and showing the tip or end portion of the lock-operating key for driving the rotary barrel or plug, i.e. rotating the rotor of the lock.

FIG. 14 shows a possible embodiment to drive the rotor 9 with the key 8 through the medium of their corresponding flattened contacting female and male areas 10, 7', respectively; any other driving configuration may however be contemplated.

Figure 15:
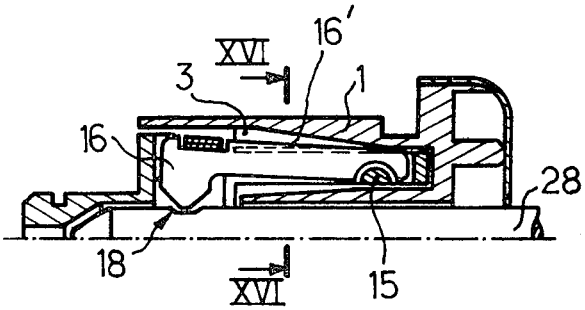
FIGS. 15 and 16 are fragmentary views similar to FIGS. 11 and 12, respectively, and showing the locking of the lock by a false or wrong key, in longitudinal half-section and in partial cross-section taken upon the line XVI—XVI of FIG. 15, respectively.
Figure 16:
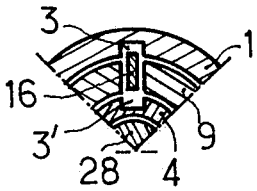

In FIGS. 15 and 16 is seen a false or wrong key 28 the shank diameter of which enables same to be thoroughly inserted into the lock but the notch 18 of which does not correspond to that of the original right key; in such a case, this improper notch causes the mating lever 16 to be lifted or swung radially outwards, the radially outward edge portion 16' of which illustrated by the perspective view in FIG. 20 then engages the radially outer longitudinal groove 3 of the stator 1 thereby preventing any rotation of the rotor. If the improper recess 18, instead of having an insufficient or too shallow depth, on the contrary exhibits an abnormally large depth, a locking is again secured but not by the radially inner longitudinal grooves 3' provided in the cylindrical core portion 4 of said stator, somewhat like what occurs when the key is being withdrawn from the lock.

In FIGS. 17 and 18 is shown how the locking of the lock is effected when the key has been withdrawn; the elastic ring 17 moves or swings the levers 16 back towards the longitudinal centre line axis of the lock and where radially inner edge portions 16'' then engage said radially inner longitudinal grooves 3' thereby locking or holding the rotor 9 against rotation.

Figure 19:
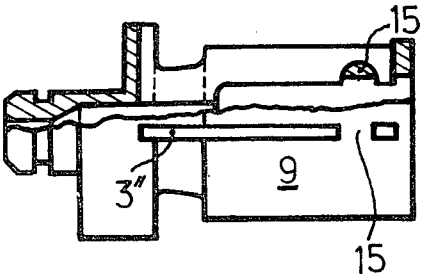
FIG. 19 shows the lock rotor in half-section illustrating an opening, slot or slit wherein an aforesaid rigid lever is radially movable.

FIG. 19 enables also to understand the process of mounting the removable pawl-like levers 16 onto the rotor, said levers bearing each one on a projection or protrusion 15 forming a pivot means therefor.

Finally FIG. 20 is a perspective view showing a rigid lever 16 comprising on its outer longitudinal edge or side 16' a notch 20 adjacent to one of its ends and adapted to keep or retain the elastic ring 17 in position; a nose 21 extending substantially at right angles with respect to the main arm portion of each lever 16 is formed with an end portion substantially complementary of or corresponding in mating relationship to the shape of the notch provided in the key, said lever exhibiting at its other end in the vicinity of a retaining finger-like portion 23, a recess 22 formed on the radially inner edge or side portion of said lever arm portion and adapted to co-operate with the bearing and retaining pivot means 15 having the shape of a boss or of a segment of a half-cylindrical rod in this instance; said bearing and retaining means 15 may however assume any other suitable shape enabling to provide a retaining pivotal connection.

The clearance provided between the parts 1 and 9 allows the rotation of the rotor 9 and the groove 27 allows the rotation of the assembly consisting of the swinging or pivoting rigid levers connected to the rotor, through the elastic clamping action of the ring 17, each lever being pivotally connected for swinging motion about a corresponding bearing means 15.

The stator is provided with equal pluralities of radially outer and inner grooves such as 3 and 3' into which the respective outer and inner edge portions 16' and 16'' of the main arm portions of said rigid levers 16 engage or are received or accommodated, respectively, when the side noses and legs 21 of said levers are moved away from or towards the centre line axis of the lock when inserting the key by those portions of the cylindrical shank of the key 8 which are devoid of notches or recesses of adequate depths; or still when the key is withdrawn, the noses or lugs 21 of the pawls 16 being then returned by the elastic ring 17 to the inward retracted positions as shown in FIGS. 17 and 18 in which it is seen that the inner edge 16'' of the arm portion of the pawl 16 engages or enters the inner groove 3' provided in the stator in registering or confronting relation to the corresponding outer groove 3, thereby preventing any rotation of the rotor so as to effet the locking thereof.

In order that the rotor may be unlocked it is necessary as in the case of the lock with blade-like elements disclosed hereinbefore that the following requirements or conditions be complied with or met simultaneously:

1. the key shank formed with notches should be inserted completely into the lock;
2. the notches (or recesses) of the key lift or swing the pawls outwards, in view of their depths, located exactly at the positions of the noses of the levers, so as to radially centre or cylindrically align all the levers within the slots provided radially in that portion of the rotor which corresponds to the gap just sufficiently wide provided between the outer cylinder and the inner cylinder of the stator for allowing the rotation of the rotor;
3. the notches should be located exactly at the positions of the lever noses the shapes and sizes of which should correspond to the shapes and depths or sizes of said notches; the noses may be arranged or distributed according to N positions along the longitudinal extents of their levers or along the generating lines of the cylindrical configuration of the lever assembly and according to X angular positions.

There is thus available as with the lock of the foregoing embodiments previously described, a new variable with a view to complicate the code of the key, which depends upon:

1. the lengths of the levers;
2. the number of levers;
3. their azimuthal distribution about the centre line axis of the lock;
4. the sizes of their noses;
5. the longitudinal distribution of the noses;
6. the shapes of these noses;
7. the shape of the key shank end portion adapted to drivingly engage the rotor and varying in accordance with the cavity 10 of the rotor, which shape exhibits a flattened configuration 7' in the example illustrated.

This last embodiment thus differs from the previous ones by an increased safety of operation and reliability of the lock owing to the fact that the elastic blade-like elements of the locking member (the self-acting biasing action for returning same to the initial locking position when the key has been withdrawn is effected by the elastic flexure or bending of each blade-like element) are replaced by rigid locking levers which are moved back to their initial positions by one single elastic ring exerting a centripetal return or biasing force onto those ends of said levers which are located opposite to or remote from the pivotal connections thereof.

The elastic ring 17 may be made from natural or synthetic rubber or from silicone based elastomeric materials or the like capable of withstanding temperatures ranging from about −80° to +280° or even +340° C.

The use of an elastic ring-shaped element providing a centripetal return or biasing action offers in particular the advantage of decreasing the finished diameter of the lock stator and of simplifying the mounting or assembling step since one single elastic ring, serving as a return spring, replaces as many individual or separate radial springs as their are rigid levers distributed over the sleeve-like portion of the rotor.

The new process of manufacture, of mounting or assembling and of biasing the locking members having the shape of rigid levers offers the following simultaneous advantages:

a. Omission of the bending step for shaping the ends of the previously described elastic blade-like elements into the desired noses, the arm and nose portions of the rigid levers being obtained through punching or cutting in one single step.

b. Omission of the cage made from blade-like elements of the previously described lock as well as of the manufacturing steps for keeping same in position so as to fasten same to the rotor, these steps being replaced by a weldless mounting through mere insertion of the levers into the respective slots of the rotor with corresponding positioning of the lever retaining fingers in bearing relationship onto their pivot means and slipping the elastic ring over the opposite ends of said levers. This new means for detachably or removably connecting said rigid levers to the rotor enables to avoid the manufacturing scrapping due to the use of a defective lever while allowing the replacement thereof.

c. The thickness of a rigid lever in the transverse or circumferential direction being much smaller than the width of an aforesaid elastic blade-like element, it results therefrom the possibility of distributing azimuthally a larger number of levers about the longitudinal centre line axis of the lock thereby providing the industrial result of substantially increasing the total final amount of possible code combinations.

d. Finally this industrial mounting process with unitary elastic return or bias action of the locking members rendered detachable or removable enables during manufacture to replace without any loss of time any defective lever by a correct lever thereby providing the industrial result of increasing the efficiency or yield of the working station for mounting said locking members and at the same time of decreasing the amount of scrapped locks.

It should be understood that the invention is not at all limited to the forms of embodiment described and shown herein which have been given by way of example only. Accordingly the invention includes all the means forming technical equivalents of the means described as well as any combinations thereof when same are carried out according to the gist of the invention and within the scope of the appended claims.

What is claimed is:

1. A safety clinder lock comprising a hollow stator body, a key-responsive inner cylindrical rotor member mounted within said stator body and rotatable by a removable key formed with notches and insertable into said rotor member, and key-operated locking means carried by said rotor member, said stator body comprising an outer cylindrical casing portion and an inner substantially cylindrical core portion at least partially co-extensive with and in coaxial relationship to said outer casing portion to leave therebetween an intermediate annular space into which at least one portion of said rotor member extends, an outer surface of said inner core portion being formed with a number of circumferentially spaced, longitudinally extending grooves; said locking means comprising an assembly of circumferentially spaced, elongated elements secured at one end to said rotor member and extending longitudinally of the lock, said elements being disposable with clearance in said annular intermediate space to be rotatable therein; resilient biasing means urging said elongated elements radially inwardly into said grooves of said inner core portion to hold said rotor member against rotation and being shiftable, against the action of said biasing means upon the insertion of a correctly coded key, radially outwardly to be disposed within said intermediate annular space and thus to allow free rotation of said rotor member, each elongated element being formed with a radially inwardly projecting catch element engageable with said key in the fully inserted position of the latter, wherein the improvement consists in that each elongated element comprises a rigid lever pivoted at one end for movement in a generally radial plane and wherein said biasing means comprises an elastic ring extending around the assembly of said levers to urge these levers towards their radially inward positions.

2. A device according to claim 1, wherein each lever is mounted with clearance within a corresponding one of a plurality of longitudinal slots of said rotor member to be freely displaceable therein.

3. A device according to claim 2, wherein the inner wall of said outer cylindrical casing portion is formed with longitudinally extending circumferentially spaced grooves registering in confronting relationship with corresponding grooves of said inner core portion and to receive said elongated elements therein when deflected radially outwards upon insertion of an incorrectly coded key to hold said rotor member against rotation, each lever having a dimension in the radial direction which is greater than the depth of the corresponding groove of the outer cylindrical casing portion and of the stator core portion, respectively.

4. A device according to claim 1, wherein each lever is detachably pivoted to said rotor member by a recess provided on the radially inner side of said longitudinal element towards one end thereof and embracing a retaining protrusion forming a projecting boss integral with said rotor member, said boss having a shape complementary of that of said recess.

5. A device according to claim 4, wherein said protrusion consists of a half-torus shaped ring segment with half a round cross section.

6. A device according to claim 1, wherein said key is provided with an end portion having a shape exhibiting a flattened configuration and received within a cavity of complementary shape of said rotor member.

7. A device according to claim 1, wherein said elastic ring is made from an elastomeric material withstanding temperatures ranging from −80° to +340° C.

8. A device according to claim 1, wherein said elastic ring is located within corresponding notches provided on a radially outer edge of said levers.

* * * * *